US006363971B1

(12) United States Patent
Kaylan et al.

(10) Patent No.: US 6,363,971 B1
(45) Date of Patent: Apr. 2, 2002

(54) INTEGRATED GAS VALVE ASSEMBLY

(75) Inventors: Ali Kaylan, St. Joseph; Delbert M. Halling; Marcus R. Fischer, both of Stevensville; Robert H. Ashton, Watervliet, all of MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/716,599

(22) Filed: Nov. 20, 2000

(51) Int. Cl.[7] ..... F16K 11/20
(52) U.S. Cl. ..... 137/883; 251/248
(58) Field of Search ..... 137/883, 884; 251/248

(56) References Cited

U.S. PATENT DOCUMENTS

| | | | | |
|---|---|---|---|---|
| 2,025,244 A | * | 12/1935 | Morehead et al. | 251/248 |
| 4,444,551 A | | 4/1984 | Mueller et al. | 431/25 |
| 4,518,345 A | | 5/1985 | Mueller et al. | 431/24 |
| 4,604,046 A | | 8/1986 | Mueller et al. | 431/2 |
| 4,615,282 A | | 10/1986 | Brown | 110/186 |
| 4,812,963 A | | 3/1989 | Albrecht et al. | 364/131 |
| 4,870,993 A | * | 10/1989 | Casuso | 137/883 |
| 4,914,566 A | | 4/1990 | Steutermann | 364/167 |
| 4,925,386 A | | 5/1990 | Donnelly et al. | 431/28 |
| 4,971,024 A | | 11/1990 | Albon et al. | 126/39 |
| 4,993,401 A | | 2/1991 | Diekmann et al. | 126/39 |
| 5,009,393 A | | 4/1991 | Massey | 251/207 |
| 5,241,463 A | | 8/1993 | Lee | 364/400 |
| 5,836,296 A | | 11/1998 | Hillis et al. | 126/39 |
| 5,988,215 A | * | 11/1999 | Martin et al. | 137/613 |
| 6,036,107 A | * | 3/2000 | Aspen et al. | 14/61 |

* cited by examiner

*Primary Examiner*—John Fox
(74) *Attorney, Agent, or Firm*—Joel M. Van Winkle; Robert O. Rice; Stephen Krefman

(57) ABSTRACT

A gas valve assembly for forming a plurality of valves is provided which includes a unitary valve body having a gas supply passage interconnected to a plurality of flow control chambers wherein the gas supply passage is interconnected with a supply of gas. A plurality of valve plugs corresponding in number to the number of flow control chambers are provided wherein each of the valve plugs is rotatably disposed in one of the flow control chambers. A plurality of gear train assemblies operate for rotating the valve plugs within the flow control chambers. A valve cover encloses the plurality of gear trains and mounts to the valve body. A plurality of motors, secured to the valve cover, operate to rotate the valve plugs within the flow control chambers, wherein the plurality of flow control chambers and corresponding valve plugs form a plurality of valves provided in a single valve body.

17 Claims, 6 Drawing Sheets

INTEGRATED GAS VALVE ASSEMBLY

BACKGROUND OF THE INVENTION

1. Field of the Invention

This invention relates to gas valves for use with cooktop gas burners or dryers, and more particularly is related to an integrated or ganged gas valve assembly wherein a plurality of gas valves are provided in a unitary gas valve body.

2. Description of the Related Art

A gas range typically includes a cooktop having a plurality of gas burners wherein each of these gas burners receives gas through a gas distribution system. Conventionally, communication between the external gas supply and each of the burners is controlled by a plurality of independent gas valves. U.S. Pat. No. 4,971,024, for example, discloses a gas cooktop system wherein a plurality of burners are controlled by a plurality of valves. The flow rate of gas through each of these valves is controlled via the rotation of an associated knob. Gas flow to the valves is accomplished through a gas manifold or gas pipe rail.

With the use of modem electronic controls, there is a need for gas distribution systems in cooktops which do not rely on the rotation of manual knobs for controlling gas flow to gas burners. U.S. Pat. No. 5,241,463 illustrates such a control system for gas burners. In the '363 patent, a plurality of burners are supplied gas through a corresponding number of gas valves. Each of these gas valves is rotated by a reversible gear motor. The gear motors are rotated in response to signal from a control board in accord with the operation of a keypad.

There is a need, however, for a more cost effective and compact gas valve assembly for combination with electronic controls as part of a gas cooktop or dryer.

SUMMARY OF THE INVENTION

According to the present invention, a gas valve assembly for forming a plurality of valves is provided which includes a unitary valve body having a gas supply passage interconnected to a plurality of flow control chambers wherein the gas supply passage is interconnected with an external supply of gas. A plurality of valve plugs corresponding in number to the number of flow control chambers are provided wherein each of the valve plugs is rotatably disposed in one of the flow control chambers. A plurality of gear train assemblies are also provided wherein each of the gear train assemblies has an input gear and an output shaft and the output shaft is drivingly interconnected with one of the valve plugs for rotating the valve plugs within the flow control chambers. A valve cover encloses the plurality of gear trains and mounts to the valve body. A plurality of motors are secured to the valve cover and each of the motors has a drive shaft drivingly engaging the input gear of one of the gear train assemblies such that the plurality of motors operate to rotate the valve plugs within the flow control chambers, wherein the plurality of flow control chambers and corresponding valve plugs form a plurality of valves provided in a single valve body.

The gas valve assembly of the present invention may also include a cut-off valve mounted to the valve body wherein the cut-off valve includes a flow control element. The valve body is provided with a main inlet chamber and the flow control element is disposed in the main inlet chamber.

At least in one embodiment, the valve body of the present invention may be an extruded member wherein the gas supply passage is formed as part of the extrusion process.

The gas valve assembly of the present invention may further include an elongated brace member having a plurality of collar portions rotatably engaging each of the output shafts such that the output shafts are positioned in line with the corresponding valve plug.

DESCRIPTION OF THE PREFERRED EMBODIMENT

Figure 1:
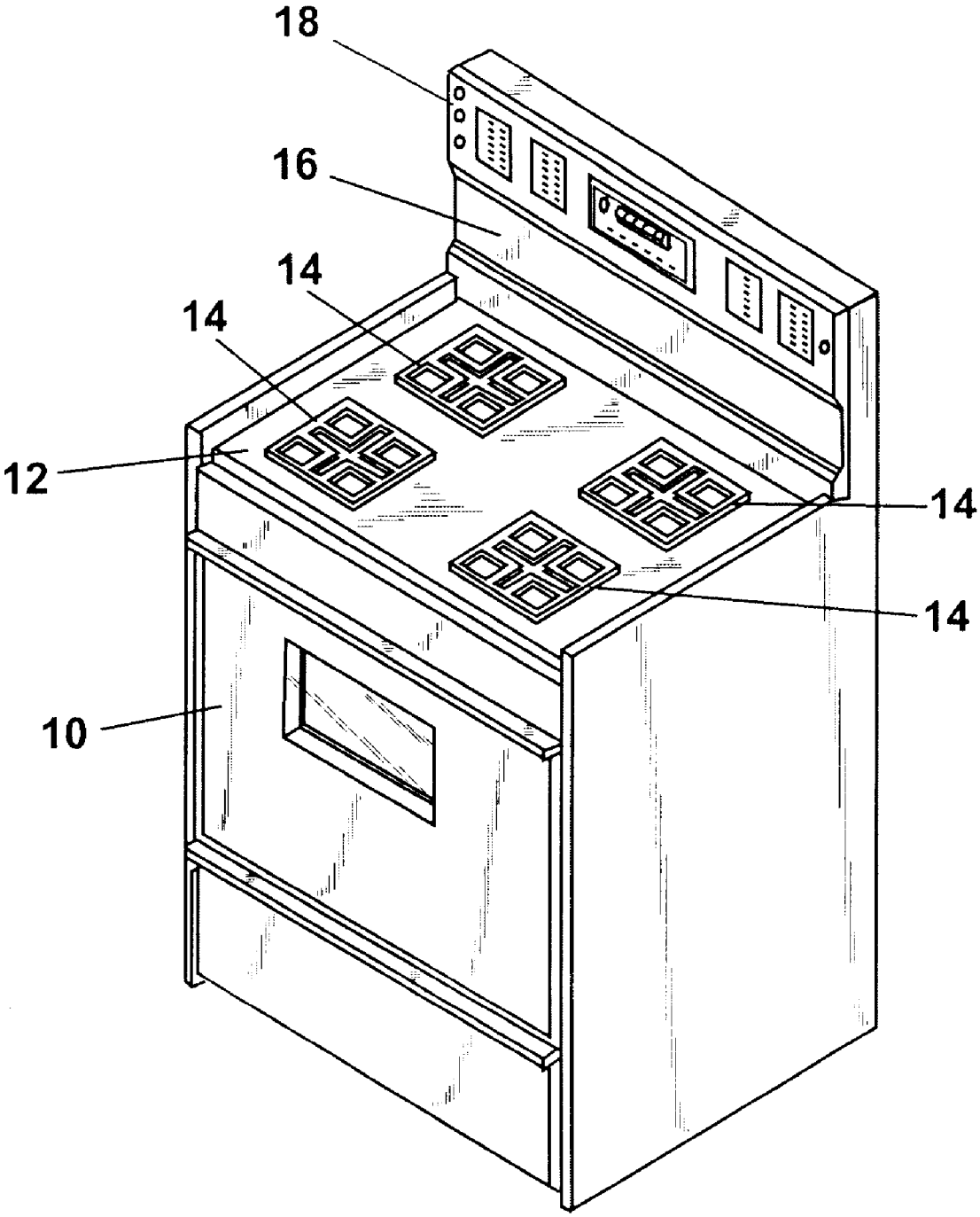
FIG. 1 is a top, front perspective view of a oven range appliance that may be employed in accordance with the invention.

Referring now to the drawings, and more in particular to FIG. 1, there is illustrated a domestic gas cooking appliance in accordance with the invention, having an oven compartment with a door 10, and a range top 12 with four burners 14. A console 16 is provided at the rear edge of the range top and includes a control panel 18. The control panel includes input device 20 (see FIG. 2) such as touch keys for imputing range control selections and may also include a display device 22 (see FIG. 2). Oven controls are not specifically shown herein, and may be of conventional type. Each of the top burners 14 may be provided with a separate control section in the control panel.

Figure 2:
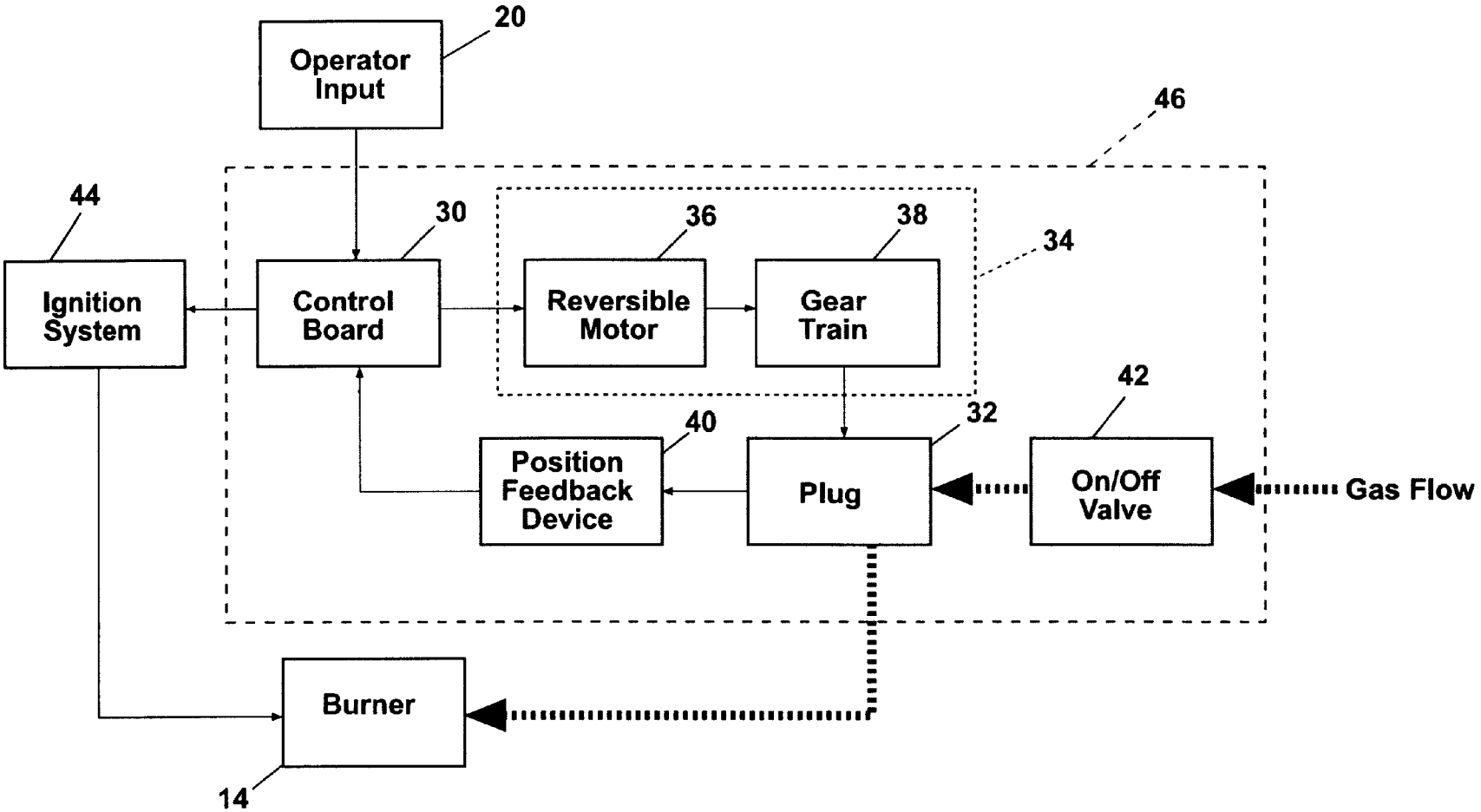
FIG. 2 is a block diagram of the control system of the appliance of FIG. 1.

In FIG. 2, a block diagram is provided illustrating a control system for use with the invention in a general manner. The present invention is directed to a gas valve system suitable for use with electronic controls such that the user interface devices—the operator input—may be located remote from the actual gas valves which control the flow of gas to the burners 14. The electronic control for the system is effected by the components on a control board 30 which maybe mounted in the rear of the appliance or underneath the burners. The control board 30 preferably includes a microcomputer and a power supply for the system wherein the control board 30 receives input from the operator input 20 for operating the four burners 14.

A gas burner 32 is associated with each of the burners and the control board 30 is operatively connected to a plurality of drive systems 34 which are each associated with one of the gas burner valves 32. In the preferred embodiment, each of the drive systems 34 includes a reversible motor 36 drivingly associated with a gear train assembly 38 for rotating one of the gas burner valve 32. The valves 32 have shafts or other position indicating elements that feedback position device 40 to apply an analog or a coded signal, such as a digital signal, to the control board 30 indicative of the position of the respective valve.

The control board 30 further controls a main shut off device or solenoid valve 42 so that the gas supply is also cut off by this valve. The valve 42 is normally closed whenever the burners are not in use and in the events of faults, etc. The control board 30 controls the energization of an ignition system 44 to light the gas burners 14.

The present invention is directed to a gas valve assembly or system wherein a plurality of gas valves are advantageously combined into a single compact and cost effective unit. In particular, in the present invention a gas valve assembly 46 is contemplated wherein a plurality of reversible motors 36, associated gear trains 38 and position encoders 40 and valves 32 are combined into a single, compact and cost effective unit.

Figure 3:
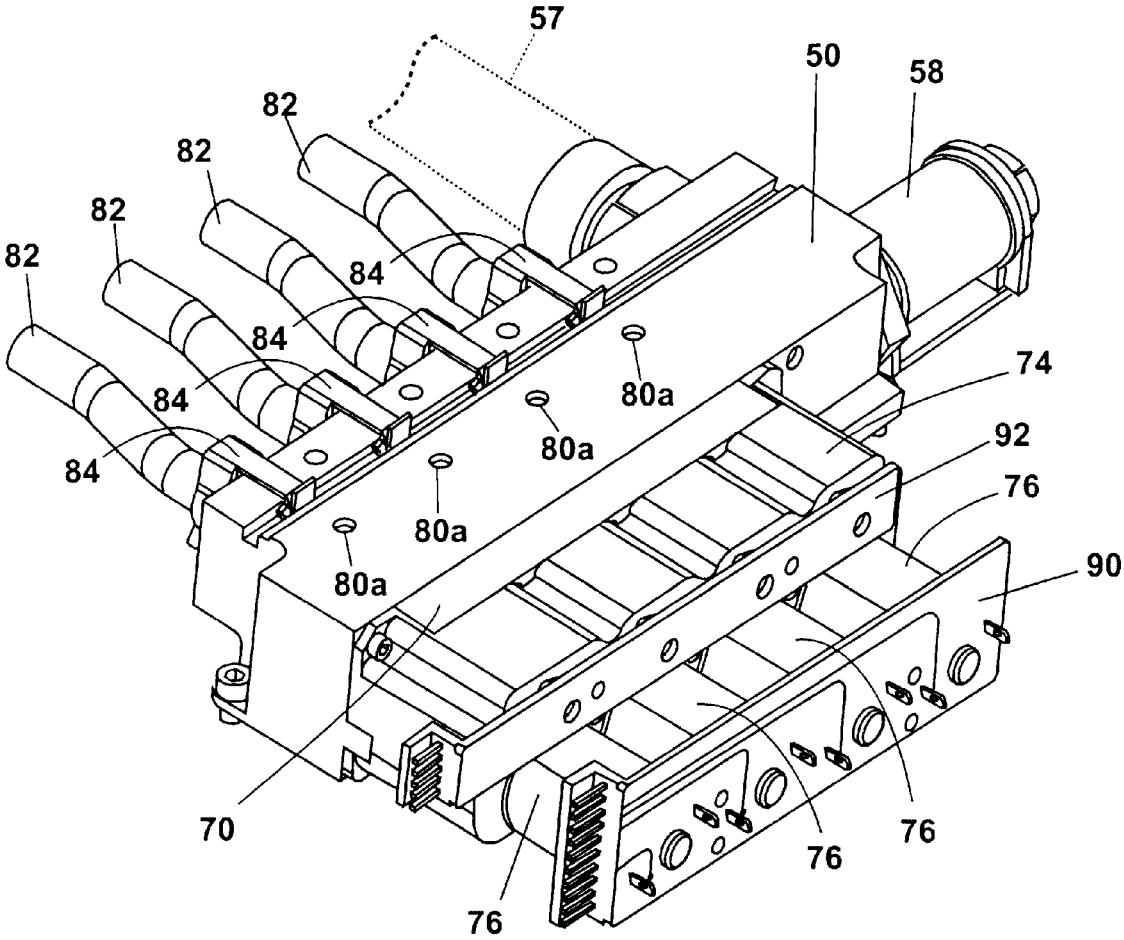
FIG. 3 is a perspective view of the flow control valve assembly of the present invention.
Figure 4:
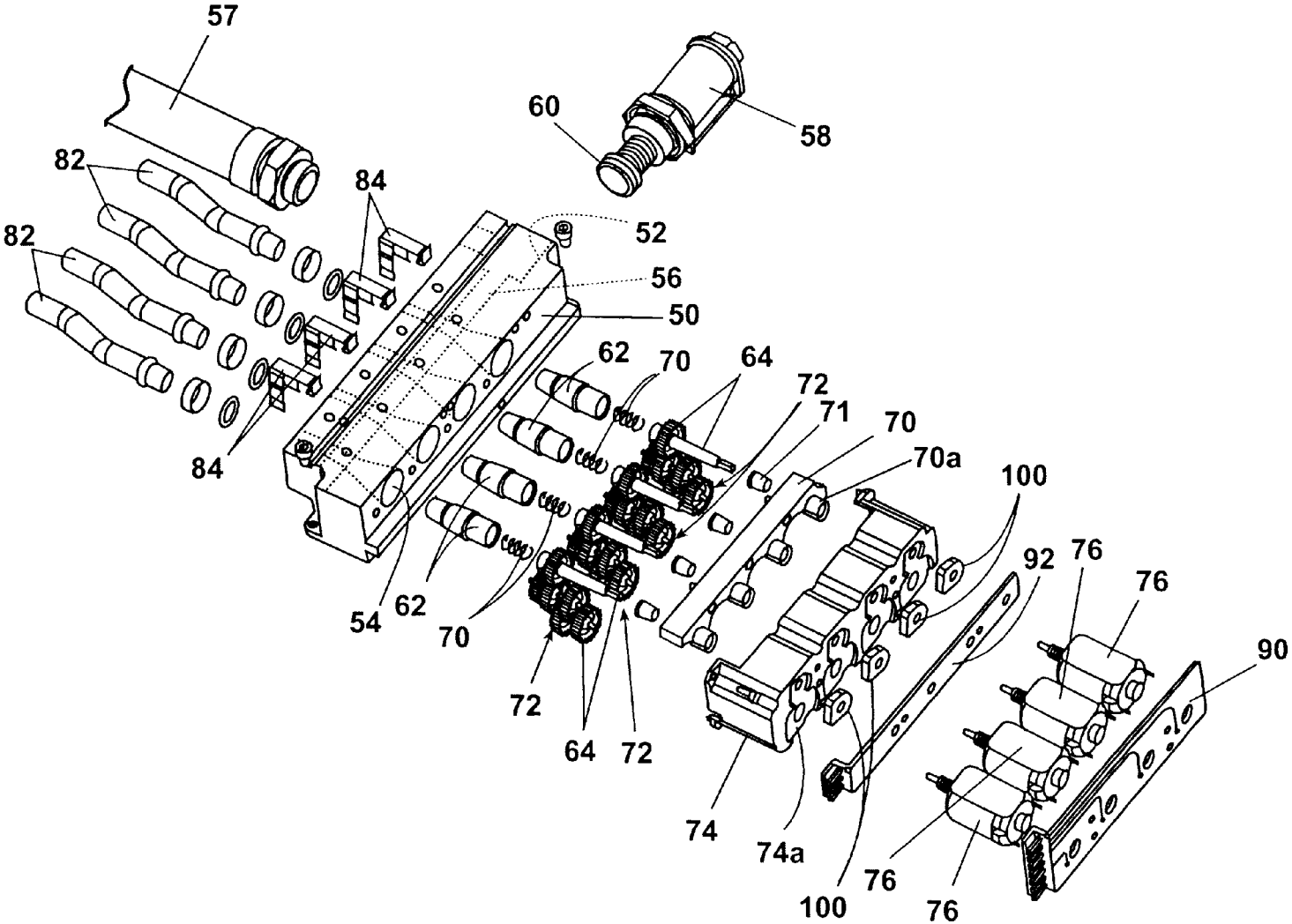
FIG. 4 is an exploded, perspective view of the flow control valve assembly of FIG. 3.
Figure 5:
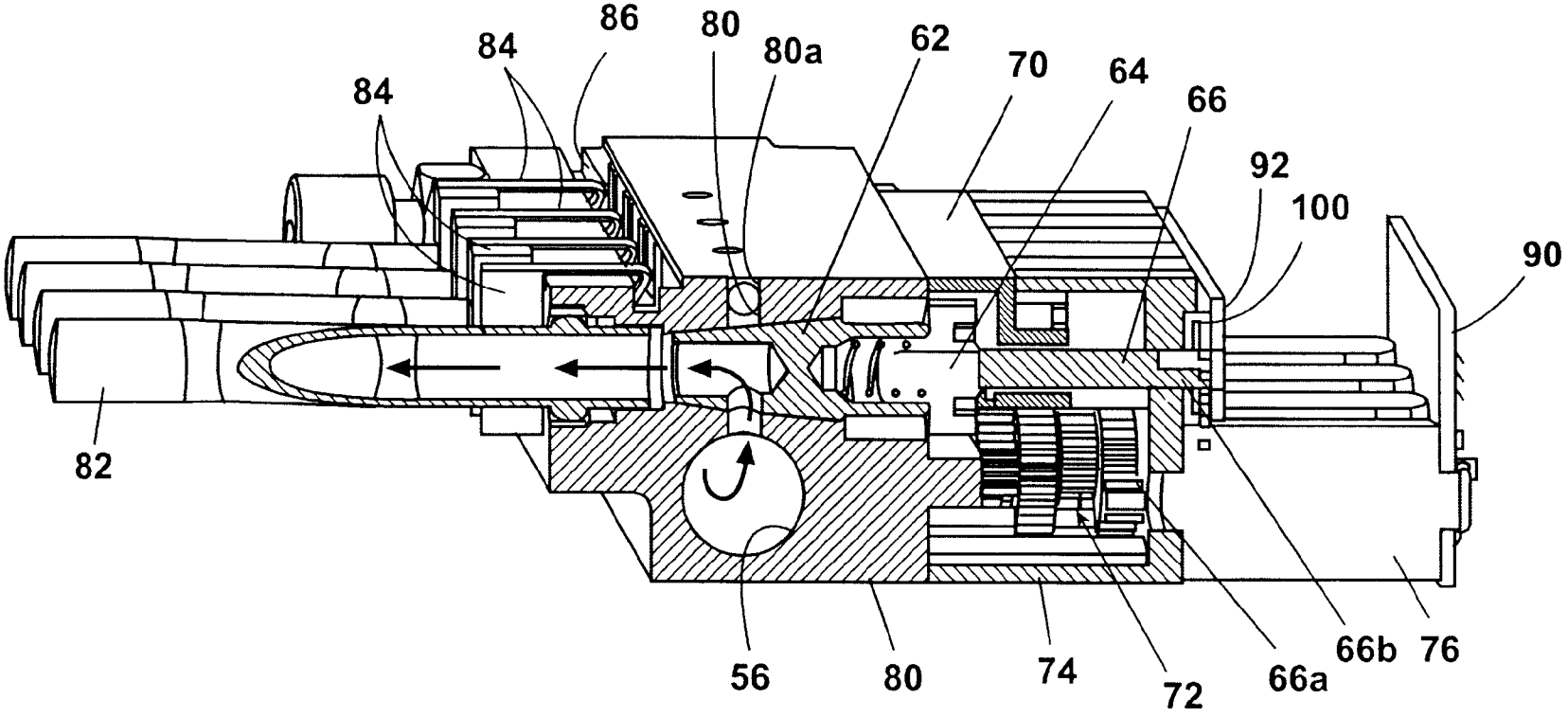
FIG. 5 is a partially cut-away, perspective view of the flow control valve assembly of FIG. 3.

Turning now to FIGS. 3–5, a more detailed embodiment of the present invention is shown wherein a gas valve assembly 46 includes a unitary valve body 50. The valve body 50 is preferably formed from aluminum but may also be made out of brass or other suitable metallic material. The valve body 50 includes a main inlet chamber 52 and a plurality of frustroconically shaped flow control chambers 54 which are flow connected with the main inlet chamber a gas supply passage 56 which passes through the valve body. An external gas supply 57 is connected to the main inlet chamber 52. An On/Off or cut-off valve 58 is mounted to the valve body 50 and includes a seal or flow control element 60 which is received into the main inlet chamber 52. The flow control element 60 acts to cut off the supply of gas to the flow control chambers 54.

While the valve body is shown as an elongated member having four flow control chambers, it should be appreciated that more or fewer flow control chambers could be provided—depending on the number of burners provided in the range cooktop. Additionally, the cut-off valve 58 can be mounted as shown in FIGS. 3 and 4 wherein the cut-off valve 58 is in line with the gas supply passage 56 or the cut-off valve could be mounted to the valve body 50 in another orientation such as perpendicular to the gas supply passage 56.

The flow control chambers 54 are formed in the valve body 50 and each receives a valve plug 62. The valve plugs 62 are rotatably disposed within the valve body 50. The plugs 62 preferably have a generally frustroconical shape and are provided with a groove or flow passage having an inlet port which is movable into alignment with a chamber inlet wherein the inlet port has decreasing flow area overlapping with the valve chamber inlet as the plug 62 is rotated from a maximum flow position to a minimum or zero flow position. The valve plugs 62 have a back end 62*a* opposite the end having the flow passage.

Figure 6:
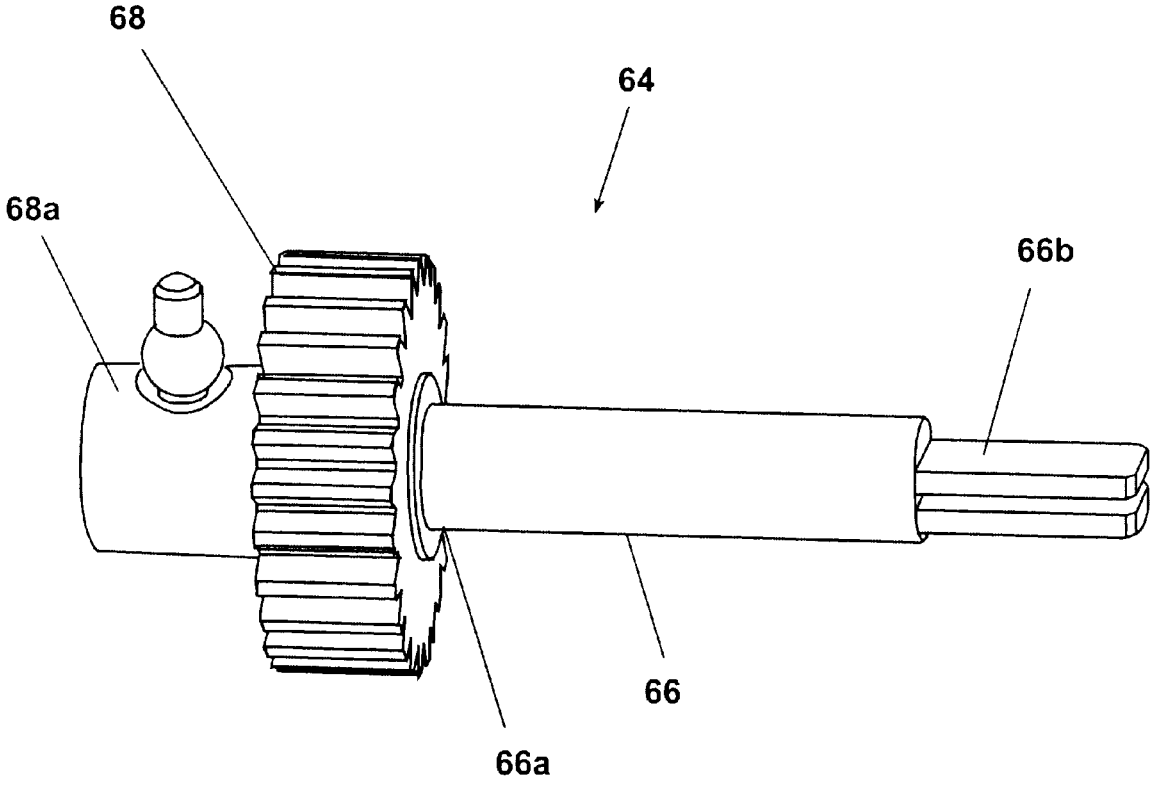
FIG. 6 is an enlarged, perspective view of the drive member of the flow control valve assembly of FIG. 3.

Each of the valve plugs 62 are drivingly connected to a drive member 64 which is shown more clearly in FIG. 6. The drive members 64 each include a shaft 66 having a first end 66*a* and a second end 66*b*. A gear element 68 is mounted to the first end of the shaft 66 and includes a keyed center boss 68*a*. The keyed center boss 68a is received into the back end 62*a* of the valve plug 62 such that the valve plug 62 rotates with the keyed center boss 68*a*. A spring 70 is compressed between the valve plug 62 and the center boss 68*a* for biasing the plug 62 into the flow control chamber 54.

The drive members 64 are positioned and held securely in place through the use of a brace 70. The brace 70 is shown as an elongated member extending along the length of the valve body 50. The brace may include a plurality of collar portion 70*a*. The collar portions 70*a* support sleeve bearings 71 which are provided about the shaft 64*a* of the drive member 64. The brace 70 is secured to the valve body 50 through the use of threaded fasteners or other known connection means.

A gear train 72 is provided to drive each of the drive members 64 through driving engagement with the gear element 68. Each of the gear trains 72 include a number of gear elements for reducing speed. The gear trains 72 can be understood to include the drive member 64.

The gear train 72 is housed within valve cover housing 74. The valve cover 74 is preferably a unitary plastic member which may be connected to the valve cover through the use of threaded fasteners or other known fastening means such as resilient snap elements. The valve cover 74 includes a mounting surface for supporting a plurality of drive motors 76. The motors 76 each include drive shafts which drivingly connect to the gear trains 72 wherein the gear trains operate to reduce the motor speed such that the drive members 64 may be rotated in a controlled, precise manner for controlling the flow of gas through each of the valve plugs.

The valve cover 74 further supports a plurality of position sensors 100. The position sensors 100 are shaft position encoders such as potentiometers or other contact or non-contact position sensors which are interconnected with the second end 66*b* of the drive members. The second ends 66*b* extend through the valve cover 74 for engagement with the position sensors. The position sensors 100 generate a signal indicative of the angular position of the drive member 64 such that the status of the valve may be measured.

While the drive members 64 and gear train assemblies 72 are shown in some detail in FIGS. 3–5, it can be appreciated that these elements could be reconfigured and still be within the scope of the present invention. The present invention contemplates some configuration of a gear reduction assembly between the drive motors 76 and the valve plugs 62 but the invention is not meant to be limited to the specific configuration shown.

One of the novel aspects of the present invention relates to the fact that the unitary valve body 50 is contemplated to be formed as an extruded member. In this way, the valve body 50 may be fabricated in a very efficient and cost effective manner. The valve body may be extruded to form an elongated member with a through center passage to form the gas supply passage 56. The flow control chambers 54 may be then machined into the valve body 50 on axes transverse to the axis of the gas supply passage. Inlet port passages 80 may be machined or drilled into the valve body 50 through the flow control chambers 54 into the gas supply passage 56. These inlet port passages 80, therefore, allow gas to flow, under the control of the valve plugs 62, from the gas supply passage 56 into gas line connection tubes 82 which are connected to the gas burners 14. After the inlet port passages 80 are formed, the open end 80*a* maybe sealed or plugged through use of any known technique.

A plurality of clips 84 may be used to secure the gas line connection tube 82 to the valve body 50. Each of these clips 84 may include a spring retention end 84*a* which may be insert into a channel 86 formed into the valve body 50 such that the clip 84 is securely attached to the valve body 50. The end of the clip opposite the spring retention end 84*a* is formed to securely engage the gas line connection tube 82.

The gas valve assembly 48 may also include a motor board 90 which provides structure for holding the motors and distributing power. The motor boards may also include the necessary electronic components for operating the valve assembly 48. The motor control board 90 may include a microcomputer and a power supply for the electronic components. A second electronic board 92 may be associated with the position sensors 100.

It can be seen, therefore, that the present invention provides a compact, unitary valve assembly for use with a plurality of burners. The unitary valve body 50 forms a plurality of flow control chambers and provides a platform for supporting the related elements.

Obviously, many modifications and variations of the present invention are possible in light of the above teachings. Thus, it is to be understood that, within the scope of the appended claims, the invention may be practiced otherwise than as specifically described above.

We claim:

1. A gas valve assembly forming a plurality of valves, comprising:

a unitary valve body having a gas supply passage interconnected to a plurality of flow control chambers wherein the gas supply passage is interconnected with an external supply of gas;

a plurality of valve plugs corresponding in number to the number of flow control chambers wherein each of the valve plugs are rotatably disposed in one of the flow control chambers;

a plurality of gear train assemblies wherein each of the gear train assemblies has an input gear and an output shaft wherein the output shaft is drivingly interconnected with one of the valve plugs for rotating the valve plugs within the flow control chambers;

a valve cover enclosing the plurality of gear trains and mounted to the valve body; and a plurality of motors secured to the valve cover, each of the motors having a drive shaft including a drive gear drivingly engaging the input gear of one of the gear train assemblies such that the plurality of motors operate to rotate the valve plugs within the flow control chambers, wherein the plurality of flow control chambers and corresponding valve plugs form a plurality of valves provided in a single valve body.

2. The gas valve assembly according to claim 1, further comprising:

a cut-off valve mounted to the valve body and having a flow control element disposed in the main inlet chamber.

3. The gas valve assembly according to claim 1 wherein the valve body is an extruded member and the gas supply passage is formed as part of the extrusion process.

4. The gas valve assembly according to claim 1, wherein the output shaft of each gear train assembly further comprises:

a drive member having a shaft, each of the shafts having a first end positioned adjacent one of the valve plugs and a second end extending toward the valve cover; and a gear element connected to the first end of the shaft, the gear element being drivingly interconnected with one of the valve plugs and being rotatably driven by one of the gear train assemblies.

5. The gas valve assembly according to claim 4, further comprising:

a position sensor being interconnected with the second end of the shaft and being mounted to the valve cover such that the position sensing element senses the angular position of the valve plug.

6. The gas valve assembly according to claim 4, further comprising:

an elongated brace member having a plurality of collar portions rotatably engaging each of the output shafts such that the output shafts are positioned in line with the corresponding valve plug.

7. The gas valve assembly according to claim 1, further wherein the output shaft of each of the gear train assemblies includes a first end drivingly interconnected with one of the valve plugs and a second end extending opposite the first end through the valve cover.

8. The gas valve assembly according to claim 7, further comprising:

a plurality of position sensors mounted to the valve cover wherein each of the position sensors is connected to one of the second ends of the output shafts of the gear train assemblies such that the position sensors can generate a signal indicative of the angular position of the associated valve plugs.

9. The gas valve assembly according to claim 1, further comprising:

an elongated brace member having a plurality of collar portions rotatably engaging each of the output shafts such that the output shafts are positioned in line with the corresponding valve plug.

10. The gas valve assembly according to claim 1, further comprising:

a plurality of gas line connection tubes corresponding in number to the flow control chambers and being mounted to the valve body to receive gas flowing from the gas supply passage though the valve plugs.

11. The gas valve assembly according to claim 10, further comprising:

a plurality of clips snap corresponding in number to the gas line connection tubes, the clips being snap connected to the valve body and engaging the gas line connection tubes for holding the tubes adjacent the valve body.

12. The gas valve assembly according to claim 9, wherein the valve body is an elongated, extruded member wherein the gas supply passage is formed as part of the extrusion process, the valve body further being formed having with a channel extending longitudinally along the valve body wherein each of the plurality of clips connect to the valve body by having a spring retention end which may be inserted into the channel such that the clip is connected to the valve body.

13. A gas valve assembly forming a plurality of valves, comprising:

a unitary valve body having a gas supply passage interconnected to a plurality of flow control chambers wherein the gas supply passage is interconnected with an external supply of gas;

a plurality of valve plugs corresponding in number to the number of flow control chambers wherein each of the valve plugs are rotatably disposed in one of the flow control chambers;

a drive member having a shaft, each of the shafts having a first end positioned adjacent one of the valve plugs and a second end extending toward a valve cover, the drive member including a gear element connected to the first end of the shaft, the gear element being drivingly interconnected with one of the valve plugs;

a plurality of gear train assemblies wherein each of the gear train assemblies has an input gear and an output gear, the output gear drivingly engaging the gear element of one of the drive members;

the valve cover enclosing the plurality of gear trains and mounted to the valve body; and a plurality of motors secured to the valve cover, each of the motors having a drive shaft drivingly connected to the input gear of one of the gear train assemblies such that the plurality of motors operate to rotate the drive members and thereby the valve plugs within the flow control chambers, wherein the plurality of flow control chambers and corresponding valve plugs form a plurality of valves provided in a single valve body.

14. The gas valve assembly according to claim 13, further comprising:

a cut-off valve mounted to the valve body and having a flow control element disposed in the main inlet chamber.

15. The gas valve assembly according to claim 13, wherein the valve body is an extruded member and the gas supply passage is formed as part of the extrusion process.

16. The gas valve assembly according to claim 13, wherein each valve further comprises:

a position sensor being interconnected with the second end of the shaft and being mounted to the valve cover such that the position sensing element senses the angular position of the valve plug.

17. The gas valve assembly according to claim 13, further comprising:

an elongated brace member having a plurality of collar portions rotatably engaging each of the drive member shafts such that the drive member shafts are positioned in line with the corresponding valve plug.

* * * * *